US011404790B2

(12) United States Patent
Sun et al.

(10) Patent No.: US 11,404,790 B2
(45) Date of Patent: Aug. 2, 2022

(54) ANTENNA APPARATUS AND MOBILE TERMINAL

(71) Applicant: Huawei Technologies Co., Ltd., Shenzhen (CN)

(72) Inventors: Qiao Sun, Xi'an (CN); Kun Li, Xi'an (CN); Liang Lu, Xi'an (CN); Xianghua Long, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 21 days.

(21) Appl. No.: 17/259,027

(22) PCT Filed: Jul. 11, 2019

(86) PCT No.: PCT/CN2019/095515
§ 371 (c)(1),
(2) Date: Jan. 8, 2021

(87) PCT Pub. No.: WO2020/011219
PCT Pub. Date: Jan. 16, 2020

(65) Prior Publication Data

US 2021/0273340 A1 Sep. 2, 2021

(30) Foreign Application Priority Data

Jul. 11, 2018 (CN) ..... 201810762908.4

(51) Int. Cl.
*H01Q 1/36* (2006.01)
*H01Q 9/42* (2006.01)
(Continued)

(52) U.S. Cl.
CPC ..... *H01Q 9/42* (2013.01); *H01Q 1/243* (2013.01); *H01Q 1/36* (2013.01); *H01Q 5/10* (2015.01);
(Continued)

(58) Field of Classification Search
CPC .. H01Q 9/42; H01Q 5/10; H01Q 5/28; H01Q 5/328; H01Q 1/243; H01Q 1/36; H01Q 1/48
See application file for complete search history.

(56) References Cited

U.S. PATENT DOCUMENTS

2015/0054693 A1 2/2015 Lin
2017/0048363 A1 2/2017 Lee et al.
(Continued)

FOREIGN PATENT DOCUMENTS

CN 105305067 A 2/2016
CN 205609756 U 9/2016
(Continued)

OTHER PUBLICATIONS

Zhang, H., et al., "The Design of Broadband Low Axial Ratio Circularly Polarized Flat Waveguide Slots Antenna," 1994-2021 China Academic Journal Electronic Publishing House, Dec. 31, 2017, 3 pages.

*Primary Examiner* — Graham P Smith
(74) *Attorney, Agent, or Firm* — Conley Rose, P.C.

(57) ABSTRACT

An antenna apparatus includes a radiator, a first grounding branch, and a second grounding branch. The radiator includes a feed point, a first radiation section, and a second radiation section. The first radiation section and the second radiation section are disposed on two sides of the feed point by a first gap and a second gap. A first ground end is disposed at one end of the first radiation section away from the first gap, and a second ground end is disposed at one end of the second radiation section away from the second gap. The first and second grounding branches intersect with the radiator. A matching circuit is coupled in series in the first grounding branch, and a first high-frequency filter is coupled in series in the second grounding branch.

20 Claims, 15 Drawing Sheets

(51) Int. Cl.

| | |
|---|---|
| ***H01Q 5/10*** | (2015.01) |
| ***H01Q 5/28*** | (2015.01) |
| ***H01Q 5/328*** | (2015.01) |
| ***H01Q 1/24*** | (2006.01) |
| *H01Q 1/48* | (2006.01) |

(52) U.S. Cl.
CPC ..... *H01Q 5/28* (2015.01); *H01Q 5/328* (2015.01); *H01Q 1/48* (2013.01)

(56) References Cited

U.S. PATENT DOCUMENTS

| | | | |
|---|---|---|---|
| 2017/0358846 | A1 | 12/2017 | Lin et al. |
| 2018/0069306 | A1 | 3/2018 | Xue et al. |

FOREIGN PATENT DOCUMENTS

| | | | |
|---|---|---|---|
| CN | 106450662 | A | 2/2017 |
| CN | 106992359 | A | 7/2017 |
| CN | 206313756 | U | 7/2017 |
| CN | 107293838 | A | 10/2017 |
| CN | 107359402 | A | 11/2017 |
| CN | 108110423 | A | 6/2018 |
| CN | 106575821 | B | 11/2019 |
| EP | 2048739 | A1 | 4/2009 |
| EP | 2498337 | A1 | 9/2012 |
| EP | 2525438 | A1 | 11/2012 |
| EP | 3331096 | A1 | 6/2018 |

ANTENNA APPARATUS AND MOBILE TERMINAL

CROSS-REFERENCE TO RELATED APPLICATIONS

This application is a U.S. National Stage of International Patent Application No. PCT/CN2019/095515 filed on Jul. 11, 2019, which claims priority to Chinese Patent Application No. 201810762908.4 filed on Jul. 11, 2018, both of which are hereby incorporated by reference in their entireties.

TECHNICAL FIELD

The present invention relates to the field of antenna technologies, and in particular, to an antenna apparatus applied to a mobile terminal.

BACKGROUND

In a global market, mobile phones utilize a plurality of frequency bands, for example, a low-frequency band from 699 MHz to 960 MHz, a medium-frequency and high-frequency band from 1710 MHz to 2690 MHz, and an ultra-high frequency band from 3400 MHz to 3600 MHz. Currently, most mobile phone antenna solutions use an antenna tuning switch to perform aperture tuning or impedance tuning, to cover more frequency bands. For example, as shown in FIG. 1, an existing antenna radiator switches different frequency bands by using two switches on a feed point and a ground point. A low-frequency mode is mainly a left-handed mode, and a high-frequency mode is mainly an inverted F antenna (inverted F antenna, IFA) mode.

Although a method of frequency modulation by using the antenna tuning switch is flexible, a switch insertion loss is introduced and a switch device is likely damaged. In addition, the switch device has a large size, which increases antenna clearance. For mobile phones with a large screen-to-body ratio, an antenna performance problem cannot be resolved only by increasing a quantity of tuning switches.

It is a research area in the industry to design an antenna apparatus that can implement multi-band range coverage without adding a switch device.

SUMMARY

Embodiments of the present invention provide an antenna apparatus, which can implement multi-band range coverage without adding a switch device.

According to a first aspect, this application provides an antenna apparatus. The antenna apparatus may include a radiator, a first grounding branch, and a second grounding branch. The radiator may include a feed point, a first radiation section, and a second radiation section. A first gap is disposed between the first radiation section and the feed point, and a second gap is disposed between the second radiation section and the feed point. In addition, a first ground end is disposed at one end that is of the first radiation section and that is away from the gap, and a second ground end is disposed at one end that is of the second radiation section and that is away from the gap. The first grounding branch may include a third ground end and a first connection end. The first connection end is located at an intersection position between the first grounding branch and the first radiation section, and a matching circuit is connected in series between the third ground end and the first connection end. The matching circuit herein may be an antenna tuning switch. The second grounding branch may include a fourth ground end and a second connection end. The second connection end is located at an intersection position between the second grounding branch and the second radiation section, and a first high-frequency filter is connected in series between the fourth ground end and the second connection end.

Specific shapes of the first radiation section and the second radiation section are not limited in this application. In an implementation, the first radiation section may extend in a straight line shape, and the second radiation section may extend in an arc shape. When the radiator is designed, the first radiation section and the second radiation section may be disposed at a position close to a corner of a mobile terminal (for example, a mobile phone). Specifically, the first radiation section may be disposed close to a short side of the mobile terminal in a same direction as an extension direction of the short side, and the second radiation section may be disposed at a position (for example, a corner position) at which a long side and the short side of the mobile terminal intersect. Such position arrangement helps reduce impact of an internal component of the mobile terminal on the antenna apparatus, and improve radiation performance of the antenna apparatus. In another implementation, the first radiation section may alternatively extend in a wavy shape or an irregular shape, and the second radiation section may alternatively extend in a straight line shape or another shape.

The antenna apparatus provided in the first aspect can support simultaneous coverage of two low frequency bands, for example, an LTE B5 and an LTE B8, and two high frequency bands, for example, an LTE B3 and an LTE B4. In addition, an adjustable component (that is, the matching circuit) is added at the third ground end to support switching to an LTE B28 frequency band. When the matching circuit is open, the radiator may radiate a LTE B28 frequency band signal. In addition, an SAR value of the antenna apparatus provided in this application is 0.2 to 0.3 less than an SAR value of a conventional antenna apparatus. In other words, compared with the conventional antenna apparatus, the antenna apparatus provided in this application can reduce an electromagnetic wave absorption rate of a user, and can prevent a human body from being hurt by an excessively strong transmitted electromagnetic wave.

With reference to the first aspect, in some optional embodiments, the antenna apparatus may simultaneously generate resonance in two low frequency bands. Specifically, when the matching circuit connected in series between the third ground end and the first connection end is in a closed-circuit state, a radiator between the first gap and the first connection end may radiate a first low frequency band signal, that is, generate resonance ①. In other words, when the matching circuit connected in series is in the closed-circuit state, the first radiation section may be configured to radiate the first low frequency band signal. The matching circuit may be configured to perform frequency modulation on the first low frequency band signal. Specifically, when the matching circuit connected in series between the third ground end and the first connection end is in the closed-circuit state, a radiator between the second gap and the second ground end may radiate a second low frequency band signal, that is, generate resonance ②. In other words, when the matching circuit connected in series is in the closed-circuit state, the second radiation section may be configured to radiate the second low frequency band signal.

It can be learned that when the matching circuit is in the closed-circuit state, the antenna apparatus may simultaneously radiate signals of two low frequency bands, so that low-frequency 2 carrier aggregation (2CA) can be supported without a need of a tuning switch.

In an optional implementation, the first low frequency band may be but is not limited to the LTE B5, and the second low frequency band may be but is not limited to the LTE B8. In this case, the first radiation section is longer than the second radiation section. In another optional implementation, the first low frequency band may be but is not limited to the LTE B8, and the second low frequency band may be but is not limited to the LTE B5. In this case, the second radiation section is longer than the first radiation section.

With reference to the first aspect, in some optional embodiments, the antenna apparatus may further generate resonance in another low frequency band. Specifically, when the matching circuit connected in series between the third ground end and the first connection end is in an open-circuit state, a radiator between the first gap and the first ground end may radiate a third low frequency band signal, that is, generate resonance ⑤. In other words, when the matching circuit connected in series is in the open-circuit state, the first radiation section may be configured to radiate the third low frequency band signal. Optionally, the third low frequency band may be, but is not limited to, the LTE B28.

With reference to the first aspect, in some optional embodiments, the antenna apparatus may further generate resonance in two high frequency bands. Specifically, a radiator between the second gap and the second connection end may radiate a first high frequency band signal, that is, generate resonance ③. The first high frequency band herein is a frequency band that is allowed to pass through the first high frequency filter. In an optional implementation, the first high-frequency filter may be a band-pass filter of the LTE B3, and is configured for the radiation section between the second gap and the second connection end, to radiate a high-frequency signal of the LTE B3. The first high frequency band may be, but is not limited to, the LTE B3. Specifically, in a state in which a current zero occurs on the first radiation section, the first radiation section may radiate a second high frequency band signal, that is, generate resonance ④. In an optional implementation, the second high frequency band may be but is not limited to the LTE B4.

With reference to the first aspect, in some optional embodiments, the antenna apparatus may further include a capacitor connected in series between the feed point and a power supply side. A capacitance value of the capacitor is within a preset range, and can simultaneously cover three low frequency bands, for example, the LTE B5, the LTE B8, and the LTE B28. Specifically, when the matching circuit connected in series between the third ground end and the first connection end is in the closed-circuit state, a radiator between the first connection end and the second ground end may radiate the third low frequency band signal, for example, the LTE B28 signal. The current zero occurs on the radiator between the first connection end and the second ground end, and radiation of a third low frequency band signal is in a half wavelength mode of the radiator between the first connection end and the second ground end.

With reference to the first aspect, in some optional embodiments, the antenna apparatus may further include a third grounding branch. The third grounding branch may include a fifth ground end and a third connection end. The third connection end is located at an intersection position between the third grounding branch and the first radiation section, and a second high-frequency filter is connected in series between the third connection end and the fifth ground end.

Specifically, the radiator between the first gap and the first connection end may radiate the second high frequency band signal. The second high frequency band herein is a frequency band that is allowed to pass through the second high frequency filter. In an optional implementation, the second high-frequency filter may be a band-pass filter of the LTE B4, and is configured for the radiation section between the first gap and the first connection end, to radiate a high-frequency signal of LTE B4. The second high frequency band may be, but is not limited to, the LTE B4. In this way, the antenna apparatus may simultaneously cover two low frequency bands and two high frequency bands, and specifically, may simultaneously cover the LTE B5, the LTE B8, and a full high frequency band.

With reference to the first aspect, in some optional embodiments, in the first gap, a lumped capacitor may be connected in series between the feed point and the first radiation section; and in the second gap, a lumped capacitor may be connected in series between the feed point and the second radiation section. In other words, the gap between the feed point and the first radiation section and the gap between the feed point and the second radiation section may be replaced with the lumped capacitor.

With reference to the first aspect, in some optional embodiments, in the first gap, a variable capacitor may be connected in series between the feed point and the first radiation section; and in the second gap, a variable capacitor may be connected in series between the feed point and the second radiation section. In other words, the gap between the feed point and the first radiation section and the gap between the feed point and the second radiation section may be replaced with the variable capacitor.

With reference to the first aspect, in some optional embodiments, in the first gap, a tuning switch may be connected in series between the feed point and the first radiation section; and in the second gap, a tuning switch may be connected in series between the feed point and the second radiation section. In other words, the gap between the feed point and the first radiation section and the gap between the feed point and the second radiation section may be replaced with the tuning switch.

With reference to the first aspect, in some optional embodiments, the antenna apparatus may further include a third grounding branch. The third grounding branch may include a fifth ground end and a third connection end. The third connection end is located at an intersection position between the third grounding branch and the first radiation section, and a second high-frequency filter is connected in series between the third connection end and the fifth ground end. In addition, a second feed point is disposed at one end that is of the first radiation section and that is close to the first gap, and the first radiation section may radiate a first frequency band signal. The second radiation section herein may be configured to detect a specific absorption ratio SAR of a second frequency band signal. The second frequency band is far higher than the first frequency band, and a difference between the second frequency band and the first frequency band is greater than a first preset threshold. A value of the first preset threshold is not particularly limited in this application.

Optionally, the second feed point may be a near field communication NFC feed point, and the first frequency band signal is an NFC signal. A frequency of the NFC signal is approximately 13.56 MHz, which is far lower than a high frequency band of mobile communications such as the LTE B3 and the LTE B4. In this way, the first radiation section may be used as a radiator that is a part of the NFC antenna, and the second radiation section may be used as a radiator that is a part of an SAR sensor. The SAR sensor may be configured to detect an SAR of a high-frequency signal. In this way, a compatible design of the NFC antenna and the SAR sensor can be implemented.

According to a second aspect, this application provides a mobile terminal. The mobile terminal may include a metal housing and the antenna apparatus described in the first aspect. In an optional implementation, the radiator of the antenna apparatus provided in this application may be a portion of the metal housing. How to use the metal housing to constitute the radiator of the antenna apparatus provided in this application is not limited herein. In another optional implementation, the radiator of the antenna apparatus provided in this application may be disposed inside the metal housing. How to arrange the radiator of the antenna apparatus provided in this application inside the metal housing is not limited herein.

BRIEF DESCRIPTION OF DRAWINGS

To describe technical solutions in embodiments of this application more clearly, the following describes the accompanying drawings required for the embodiments in this application.

DESCRIPTION OF EMBODIMENTS

The following describes the embodiments of the present invention with reference to the accompanying drawings in the embodiments of the present invention.

Figure 2:
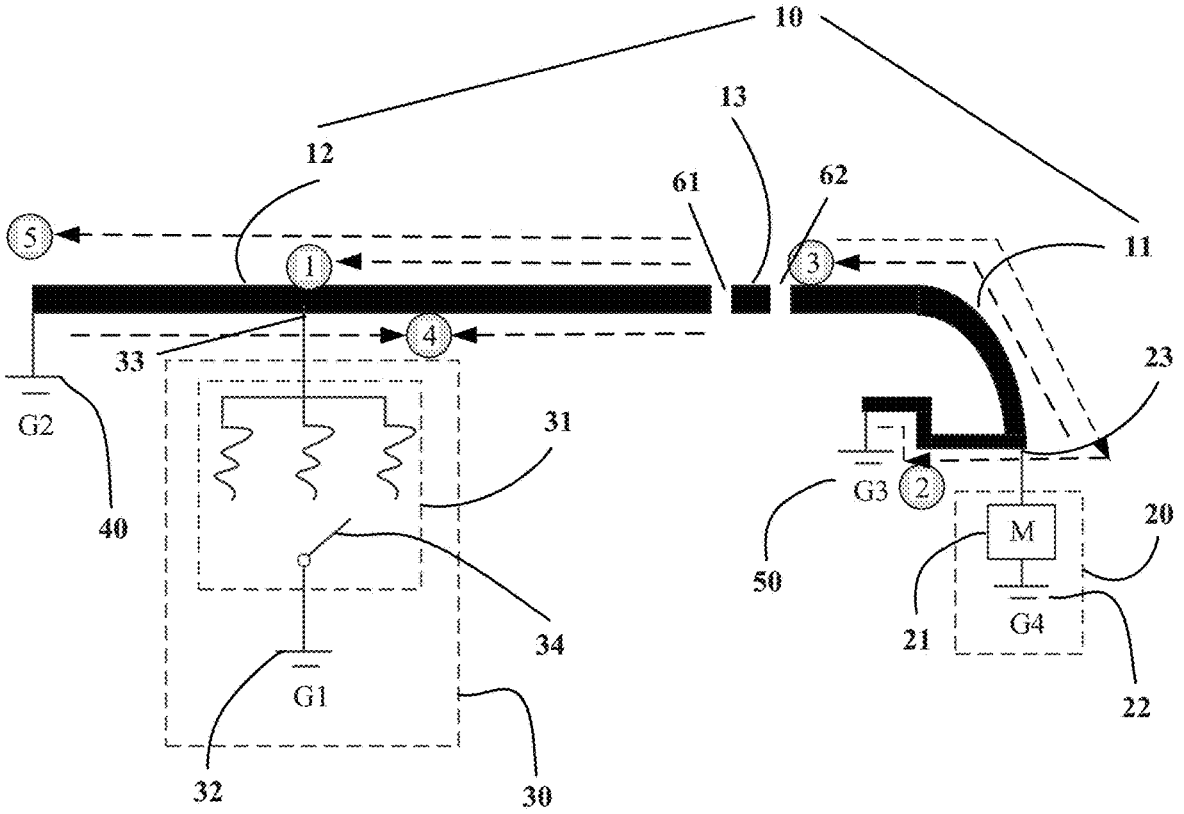
FIG. 2 is a schematic diagram of an antenna apparatus according to an embodiment of this application.

Referring to FIG. 2, G in FIG. 2 represents aground point. As shown in FIG. 2, an antenna apparatus provided in an embodiment of this application may include a radiator 10, a first grounding branch 30, and a second grounding branch 20.

The radiator 10 may include a feed point 13, a first radiation section 12, and a second radiation section 11. A first gap 61 is disposed between the first radiation section 12 and the feed point 13, and a second gap 62 is disposed between the second radiation section 11 and the feed point 13. In addition, a first ground end 40 (G2) is disposed at one end that is of the first radiation section 12 and that is away from the gap 61, and a second ground end 50 (G3) is disposed at one end that is of the second radiation section 11 and that is away from the gap 62. In other words, two radiators are disposed on two sides of the feed point 13 in the antenna apparatus shown in FIG. 2. The two radiators are not directly connected to the feed point 13, but are coupled to the feed point 13 through the gaps. A length of the feed point 13 is far less than a length of the first radiation section 12 or a length of the second radiation section 11. For example, the length of the feed point 13 is far less than a quarter of a wavelength of an LTE B7 frequency band. The length of the feed point 13 is not limited in this application. Frequency band ranges of the LTE B7 are an uplink range from 2500 MHz to 2570 MHz and a downlink range from 2620 MHz to 2690 MHz.

The first grounding branch 30 may include a third ground end 32 (G1) and a first connection end 33. The first connection end 33 is located at an intersection position between the first grounding branch 30 and the first radiation section 12, and a matching circuit 31 is connected in series between the third ground end 32 (G1) and the first connection end 33. The matching circuit 31 herein may be an antenna tuning switch.

The second grounding branch 20 may include a fourth ground end 22 (G4) and a second connection end 23. The second connection end 23 is located at an intersection position between the second grounding branch 20 and the second radiation section 11, and a first high-frequency filter 21 (M) is connected in series between the fourth ground end 22 (G4) and the second connection end 23.

Specific shapes of the first radiation section 12 and the second radiation section 11 are not limited in this application. In an implementation, the first radiation section 12 may extend in a straight line shape, and the second radiation section 11 may extend in an arc shape. When the radiator 10 is designed, the first radiation section 12 and the second radiation section 11 may be disposed at a position close to a corner of a mobile terminal (for example, a mobile phone). Specifically, the first radiation section 12 may be disposed close to a short side of the mobile terminal in a same direction as an extension direction of the short side, and the second radiation section 11 may be disposed at a position (for example, a corner position) at which a long side and the short side of the mobile terminal intersect. Such position arrangement helps reduce impact of an internal component of the mobile terminal on the antenna apparatus, and improve radiation performance of the antenna apparatus. In another implementation, the first radiation section 12 may alternatively extend in a wavy shape or an irregular shape, and the second radiation section 11 may alternatively extend in a straight line shape or another shape.

The following describes a resonance mode that can be generated by the antenna apparatus shown in FIG. 2.

Referring to FIG. 2, ①, ②, ③, ④ and ⑤ in FIG. 2 represent different resonances. The antenna apparatus may simultaneously generate the resonances 1 and 2 in two low frequency bands.

Specifically, when the matching circuit 31 connected in series between the third ground end 32 (G1) and the first connection end 33 is in a closed-circuit state, a radiator between the first gap 61 and the first connection end 33 may radiate a first low frequency band signal, that is, generate the resonance ①. In other words, when the matching circuit 31 connected in series is in the closed-circuit state, the first radiation section 12 may be configured to radiate the first low frequency band signal. Herein, that the matching circuit 31 is in the closed-circuit state means that a switch 34 in the matching circuit 31 is in a closed state. The matching circuit 31 may be configured to perform frequency modulation on the first low frequency band signal. The accompanying drawing shows, as an example, three components that can be connected to the switch 34 in the matching circuit 31. That the switch 34 is in a closed state means that the switch 34 is connected to any one of the components. The switch 34 is connected to different components for different degrees of frequency modulation. The components are not limited to the accompanying drawings, and the matching circuit 31 may have more or fewer components for connecting to the switch 34. Specifically, when the matching circuit 31 connected in series between the third ground end 32 (G1) and the first connection end 33 is in the closed-circuit state, a radiator between the second gap 62 and the second ground end 50 (G3) may radiate a second low frequency band signal, that is, generate the resonance ②. In other words, when the matching circuit 31 connected in series is in the closed-circuit state, the second radiation section 11 may be configured to radiate the second low frequency band signal.

In other words, when the matching circuit 31 is in the closed-circuit state, the antenna apparatus may simultaneously radiate signals of two low frequency bands, so that low-frequency 2 carrier aggregation (2 carrier aggregation, 2CA) can be supported without a need of a tuning switch.

In an optional implementation, the first low frequency band may be but is not limited to an LTE B5, and the second low frequency band may be but is not limited to an LTE B8. In this case, the first radiation section 12 is longer than the second radiation section 11. In another optional implementation, the first low frequency band may be but is not limited to the LTE B8, and the second low frequency band may be but is not limited to the LTE B5. In this case, the second radiation section 11 is longer than the first radiation section 12. The LTE B5 frequency band ranges are an uplink range from 824 MHz to 849 MHz and a downlink range from 869 MHz to 894 MHz. The LTE B8 frequency band ranges are an uplink range from 880 MHz to 915 MHz and a downlink range from 925 MHz to 960 MHz.

Specifically, when the matching circuit 31 connected in series between the third ground end 32 (G1) and the first connection end 33 is in an open-circuit state, the antenna apparatus may further generate the resonance ⑤ at the low frequency. Specifically, when the matching circuit 31 connected in series between the third ground end 32 (G1) and the first connection end 33 is in the open-circuit state, a radiator between the first gap 61 and the first ground end 40 (G2) may radiate a third low frequency band signal, that is, generate the resonance ⑤. In other words, when the matching circuit 31 connected in series is in the open-circuit state, the first radiation section 11 may be configured to radiate the third low frequency band signal. Optionally, the third low frequency band may be, but is not limited to, an LTE B28. The LTE B28 frequency band ranges are an uplink range from 703 MHz to 748 MHz and a downlink range from 758 MHz to 803 MHz. Herein, that the matching circuit 31 is in the open-circuit state means that the switch 34 in the matching circuit 31 is in an open state.

Referring to FIG. 2, the antenna apparatus may further generate the resonances 3 and 4 in two high frequency bands.

Specifically, a radiator between the second gap 62 and the second connection end 23 may radiate a first high frequency band signal, that is, generate the resonance ③. The first high frequency band herein is a frequency band that is allowed to pass through the first high frequency filter 21. In an optional implementation, the first high-frequency filter 21 (M) may be a band-pass filter of an LTE B3, and is configured for the radiation section between the second gap 62 and the second connection end 23, to radiate a high-frequency signal of the LTE B3. The first high frequency band may be, but is not limited to, the LTE B3. Frequency band ranges of the LTE B3 are an uplink range from 1710 MHz to 1785 MHz and a downlink range from 1805 MHz to 1880 MHz.

Specifically, in a state in which a current zero occurs on the first radiation section 12, the first radiation section 12 may radiate a second high frequency band signal, that is, generate the resonance ④. In an optional implementation, the second high frequency band may be but is not limited to an LTE B4. The LTE B4 frequency band ranges are an uplink range from 1710 MHz to 1733 MHz and a downlink range from 2110 MHz to 2133 MHz. Herein, the current zero point refers to a position at which a current is zero, and may alternatively be referred to as an inverting point.

Figure 3:
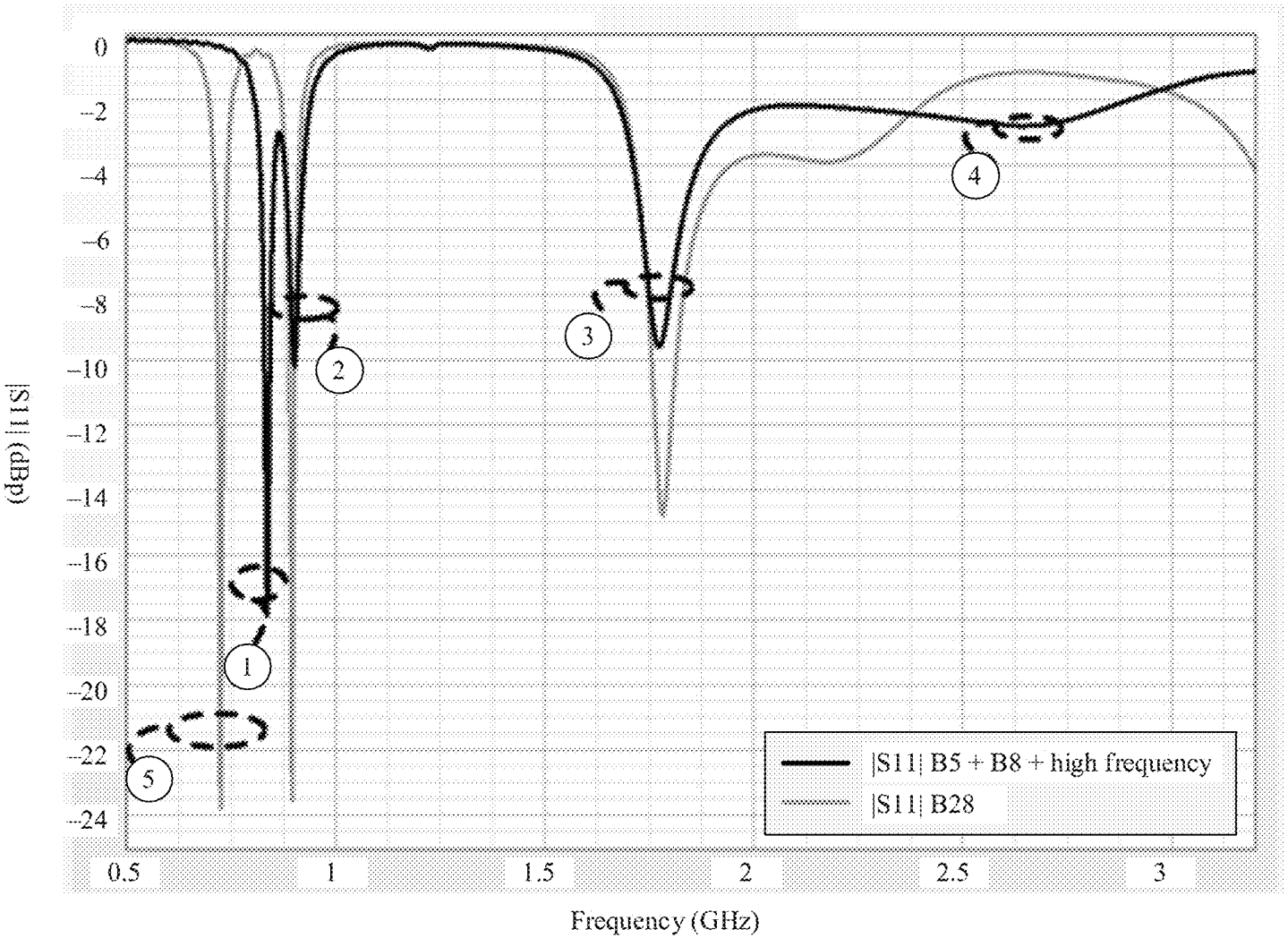
FIG. 3 is a schematic simulation diagram of five resonances generated by the antenna apparatus shown in FIG. 2.
Figure 4A:
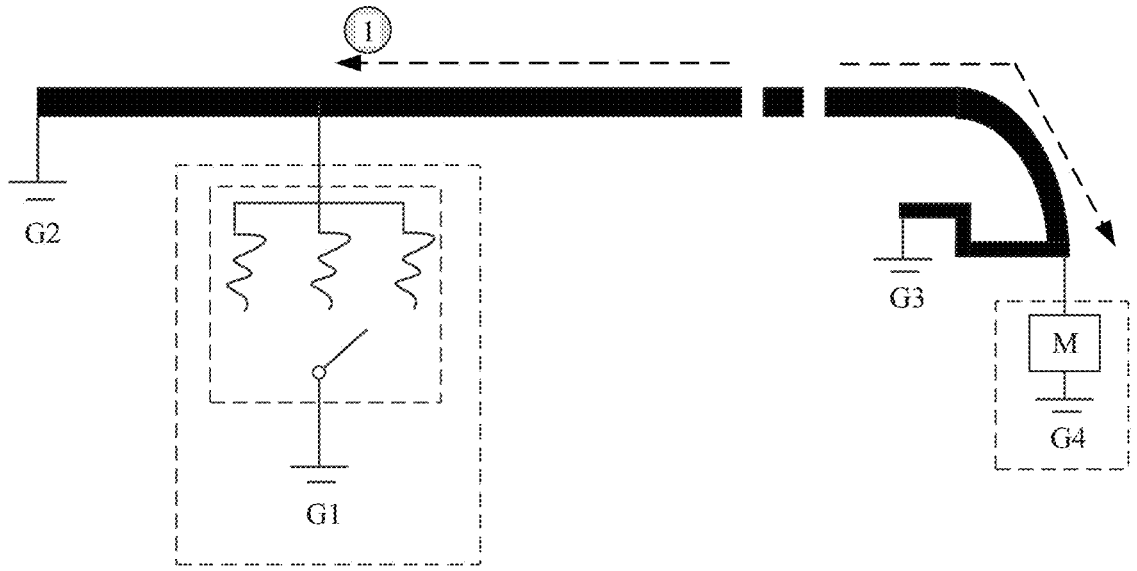
FIG. 4A is a schematic diagram of current distribution of resonance of a first low frequency band generated by the antenna apparatus shown in FIG. 2.
Figure 4B:
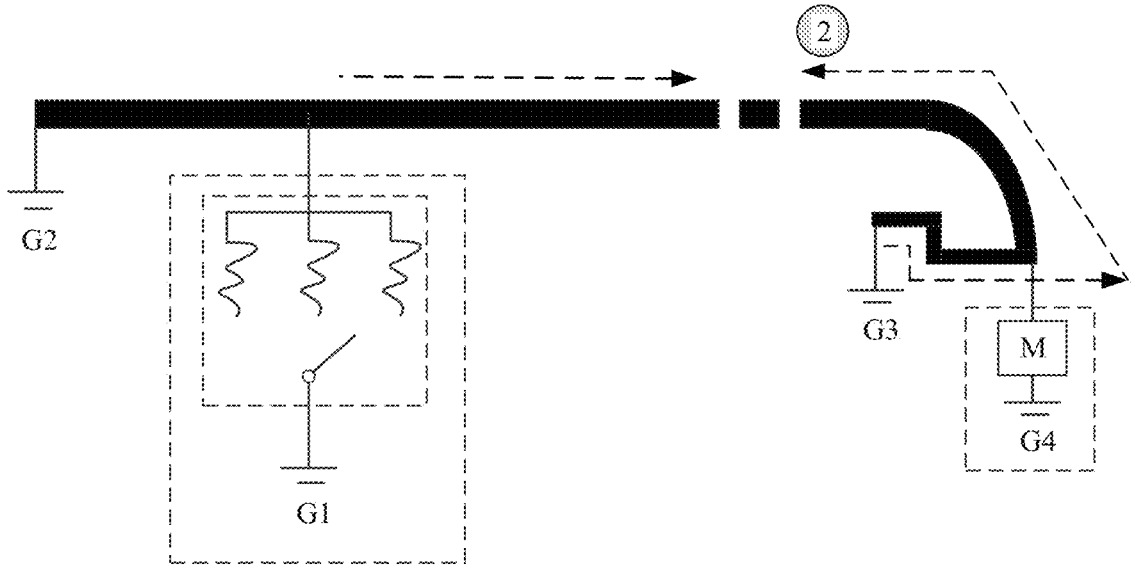
FIG. 4B is a schematic diagram of current distribution of resonance of a second low frequency band generated by the antenna apparatus shown in FIG. 2.
Figure 4C:
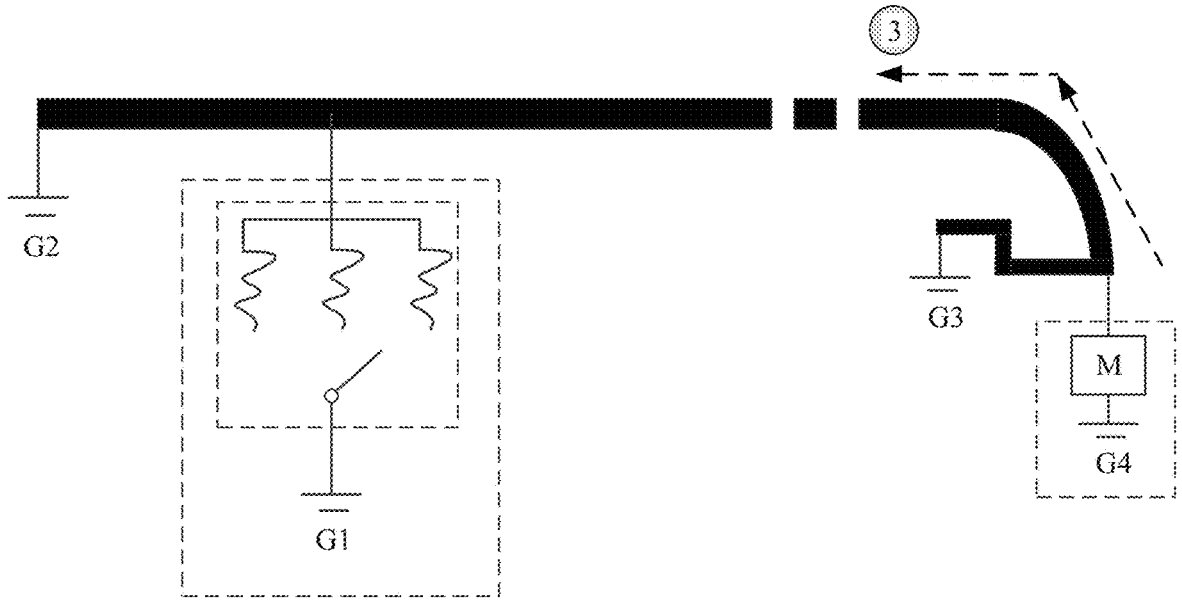
FIG. 4C is a schematic diagram of current distribution of resonance of a first high frequency band generated by the antenna apparatus shown in FIG. 2.
Figure 4D:
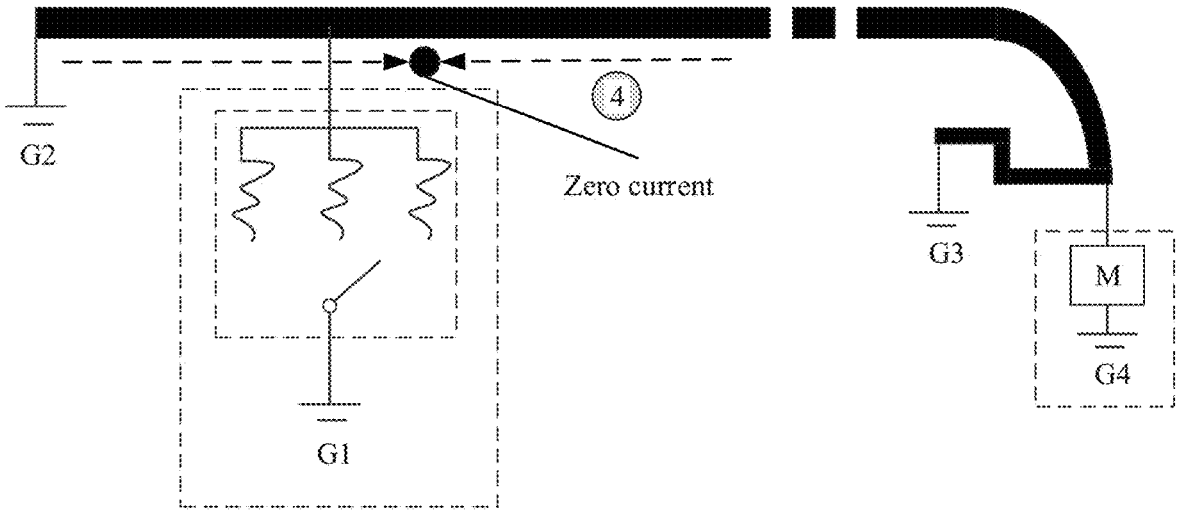
FIG. 4D is a schematic diagram of current distribution of resonance of a second high frequency band generated by the antenna apparatus shown in FIG. 2.
Figure 4E:
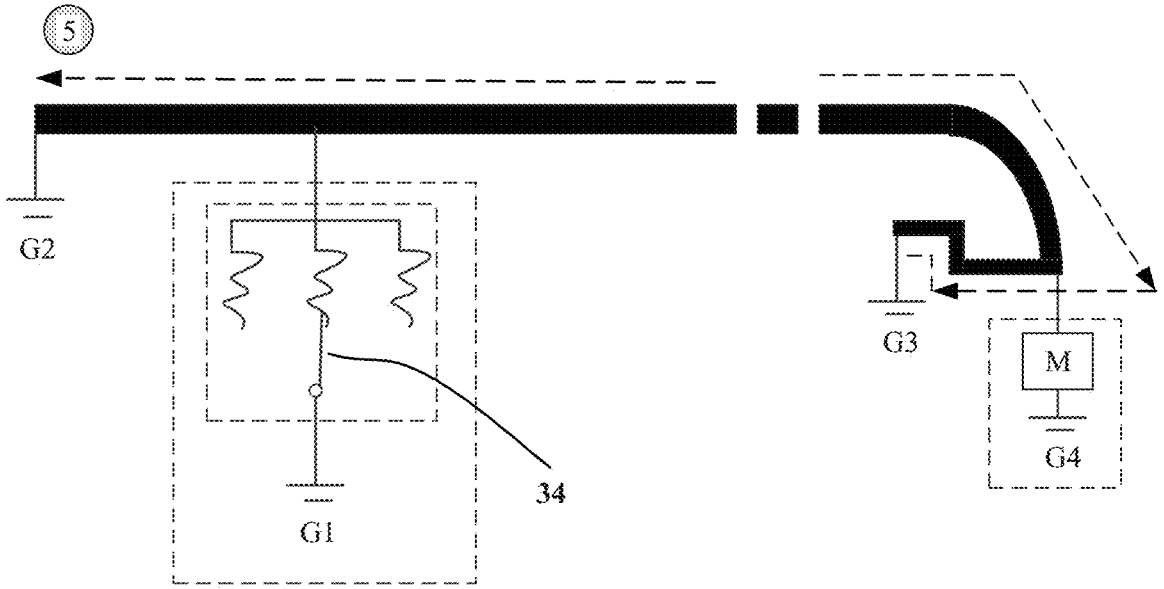
FIG. 4E is a schematic diagram of current distribution of resonance of a third low frequency band generated by the antenna apparatus shown in FIG. 2.

FIG. 3 shows simulation of a radiation signal of the antenna apparatus. The antenna apparatus may initially generate four resonances, which are respectively ①, ②, ③ and ④. When the matching circuit 31 is in an open-circuit state, the antenna apparatus may generate the resonance ⑤.

FIG. 4A to FIG. 4E respectively show current distribution of the resonances ①, ②, ③ and ④. Current distribution of the resonance ① may be shown in FIG. 4A, and the resonance ① may be a composite right left hand (composite right left hand, CRLH) mode from the first gap 61 to the third ground end 32 (G1). Current distribution of the resonance ② may be shown in FIG. 4B, and the resonance ② may be a composite right left hand (CRLH) mode from the second gap 62 to the second ground end 50 (G3). Current distribution of the resonance ③ may be shown in FIG. 4C, and the resonance ③ may be a composite right left hand (CRLH) mode from the second gap 62 to the fourth ground end 22. Current distribution of the resonance ④ may be shown in FIG. 4D, and the resonance ④ may be in a half wavelength mode from the first gap 61 to the third ground end 32 (G1) or to the first ground end 40 (G2). When the matching circuit 31 is in the open-circuit state, resonance ⑤ is generated. Current distribution of the resonance ⑤ may be shown in FIG. 4E, and the resonance ⑤ may be a composite right left hand (CRLH) mode from the first gap 61 to the first ground end 40 (G2).

It can be learned that the antenna apparatus shown in FIG. 2 may simultaneously cover two low frequency bands, for example, the LTE B5 and the LTE B8, and two high frequency bands, for example, the LTE B3 and the LTE B4. In addition, an adjustable component (that is, the matching circuit 31) is added at the third ground end 32 (G1) to switch to the LTE B28 frequency band. When the matching circuit 31 is open, the radiator 10 may radiate a signal of the LTE B28 frequency band.

Figure 5:
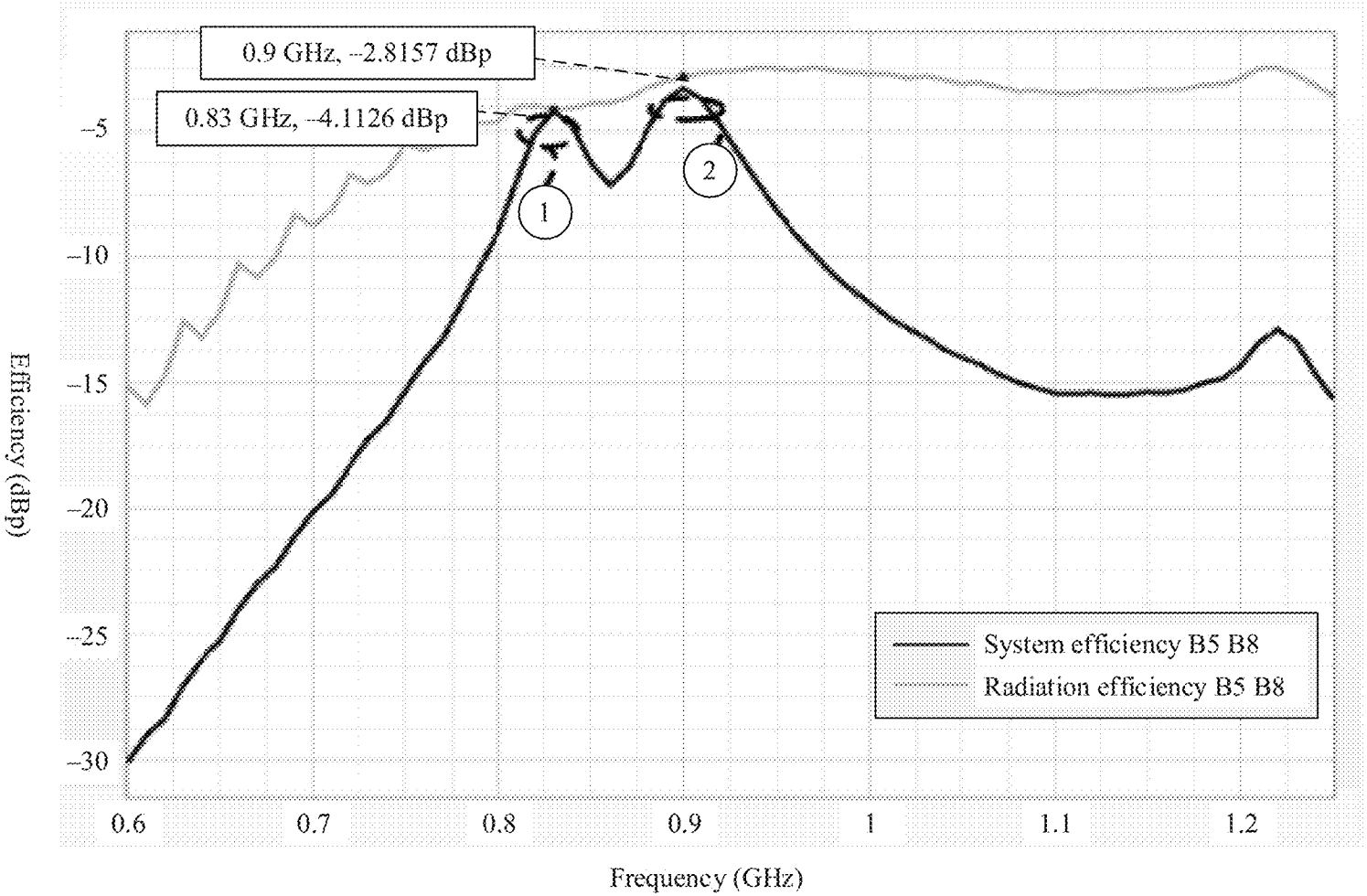
FIG. 5 is a simulation diagram of efficiency of the antenna apparatus shown in FIG. 2 radiating LTE B5 and LTE B8 signals.
Figure 6:
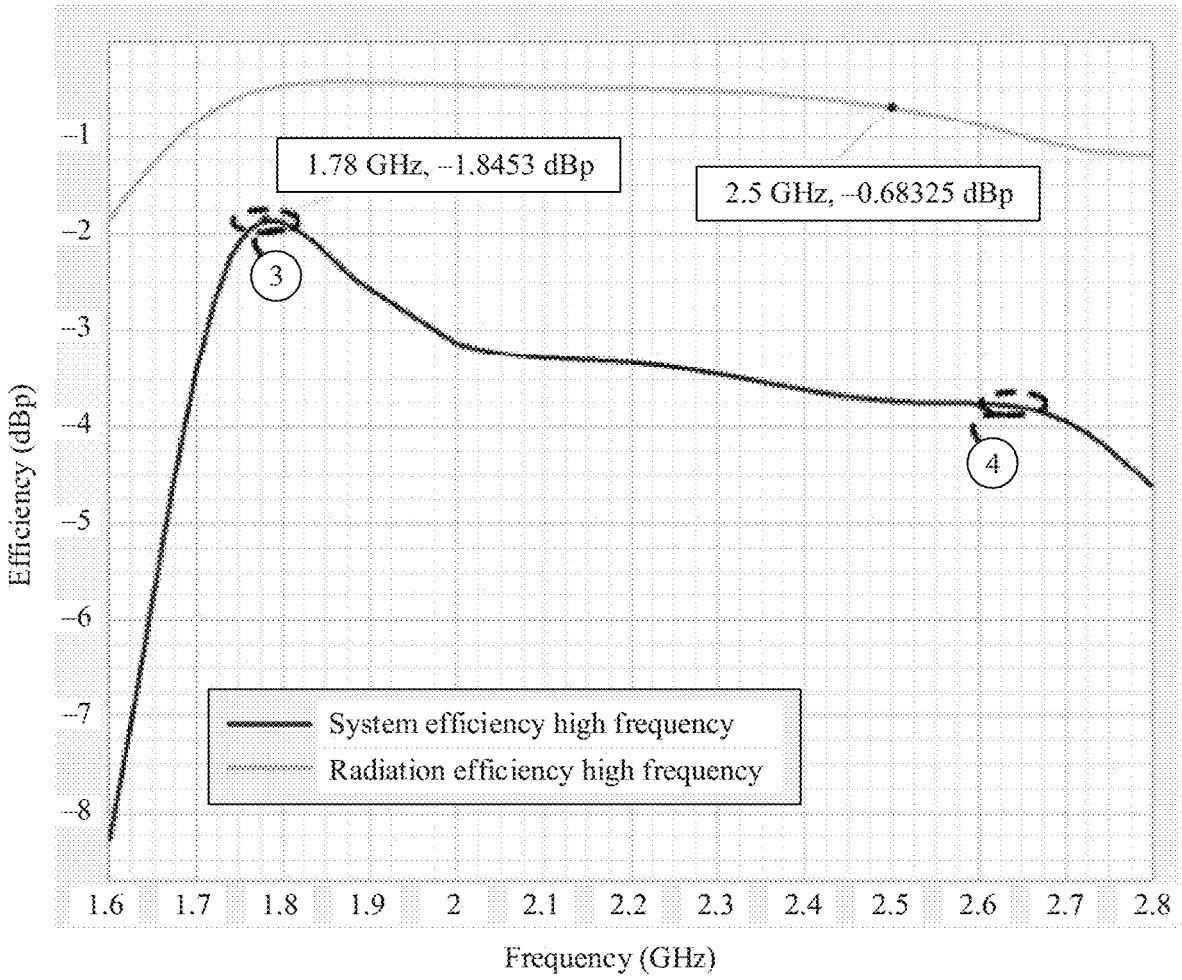
FIG. 6 is a simulation diagram of efficiency of the antenna apparatus shown in FIG. 2 radiating LTE B3 and LTE B4 signals.
Figure 7:
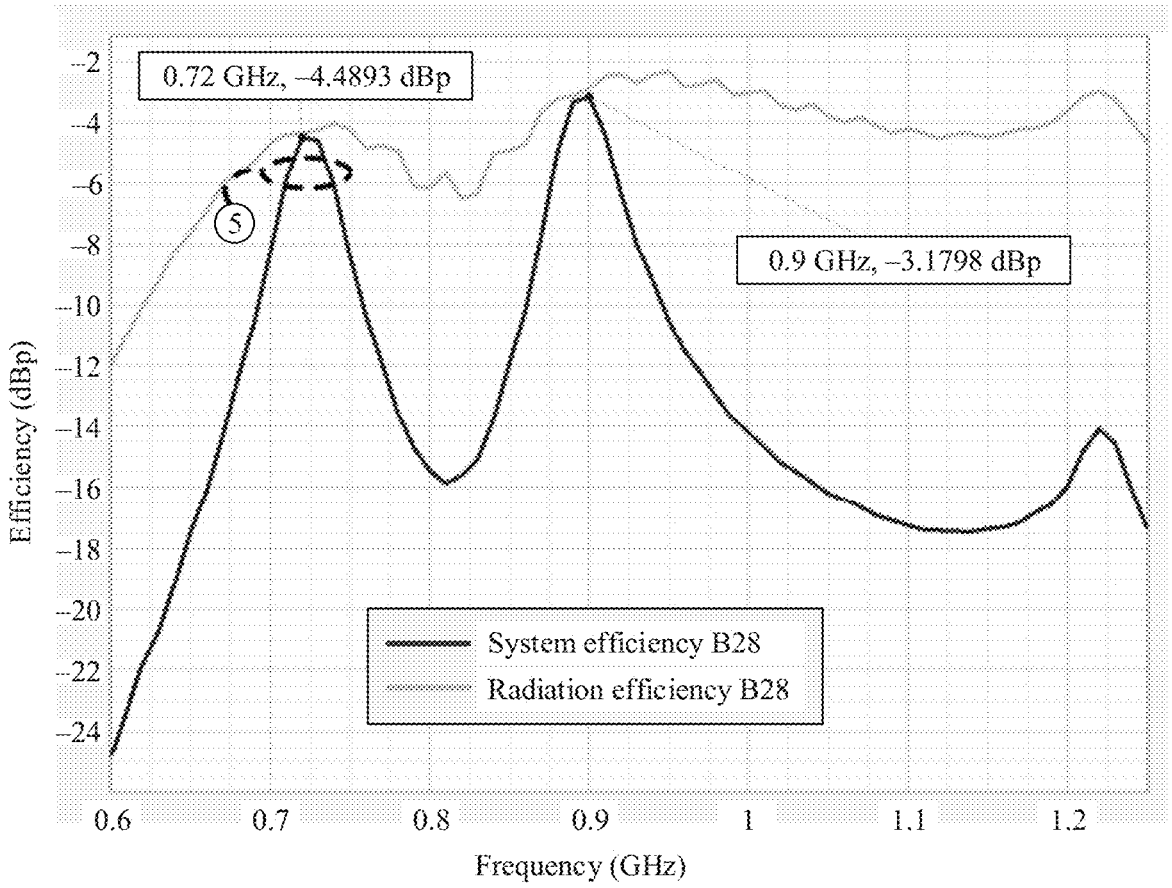
FIG. 7 is a simulation diagram of efficiency of the antenna apparatus shown in FIG. 2 radiating an LTE B28 signal.

In addition, FIG. 5 shows simulation of system efficiency and radiation efficiency of the antenna apparatus in the LTE B5 and the LTE B8. FIG. 6 shows simulation of system efficiency and radiation efficiency of the antenna apparatus in a high frequency band that ranges from 1710 MHz to 2690 MHz (including the LTE B3 and the LTE B4). FIG. 7 shows simulation of system efficiency and radiation efficiency of the antenna apparatus in the LTE B28. It can be learned that the antenna apparatus has relatively high radiation efficiency at both the low frequency and the high frequency, without an obvious efficiency dent.

Figure 1:
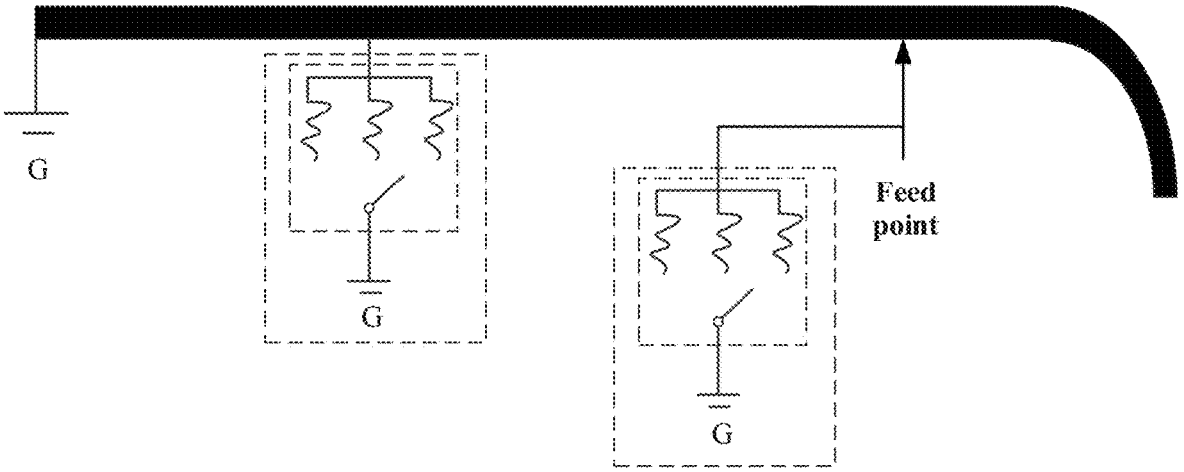
FIG. 1 is a schematic diagram of a conventional antenna apparatus.

In addition, Table 1 shows a comparison between a specific absorption rate (specific absorption rate, SAP) of the antenna apparatus (a dual-CRLH solution, referring to FIG. 2) provided in this application and a specific absorption rate (specific absorption rate, SAP) of a conventional antenna apparatus (a single-CRLH solution, as shown in FIG. 1).

TABLE 1

| | | Head SAR | | | | | | | |
|---|---|---|---|---|---|---|---|---|---|
| | | Right face contact | | Left face contact | | Body SAR | | | |
| Antenna | Frequency | | | | | Front 5 mm | | Rear 5 mm | |
| solution | MHz | 1 g | 10 g | 1 g | 10 g | 1 g | 10 g | 1 g | 10 g |
| Dual-CRLHs | 830 | 1.3 | 0.8 | 1.8 | 0.9 | 1.9 | 0.9 | 1.6 | 0.9 |
| | 900 | 1.4 | 0.9 | 1.8 | 0.9 | 1.8 | 0.9 | 1.7 | 0.8 |
| Single CRLH | 890 | 1.5 | 1.1 | 1.8 | 1.2 | 2.1 | 1.2 | 1.9 | 1.1 |

It can be learned that when efficiency is basically the same, an SAR value of the antenna apparatus (a dual-CRLH solution, referring to FIG. 2) provided in this application is 0.2 to 0.3 less than an SAR value of the conventional antenna apparatus (a single-CRLH solution, as shown in FIG. 1). In other words, compared with the conventional antenna apparatus, the antenna apparatus provided in this application can reduce an electromagnetic wave absorption rate of a user, and can prevent a human body from being hurt by an excessively strong transmitted electromagnetic wave. It can be learned from the foregoing content that, 830 MHz is in a frequency band of the LTE B5, and is a CRLH resonance mode (that is, resonance ①) generated by the first radiation section 12; and 900 MHz is in a frequency band of the LTE B8, and is a CRLH resonance mode (that is, resonance ②) generated by the second radiation section 11. Because currents of the two low frequency bands are dispersed in the first radiation section 12 and the second radiation section 11, instead of being concentrated in one area, the antenna apparatus shown in FIG. 2 can reduce the SAR value.

Figure 8:
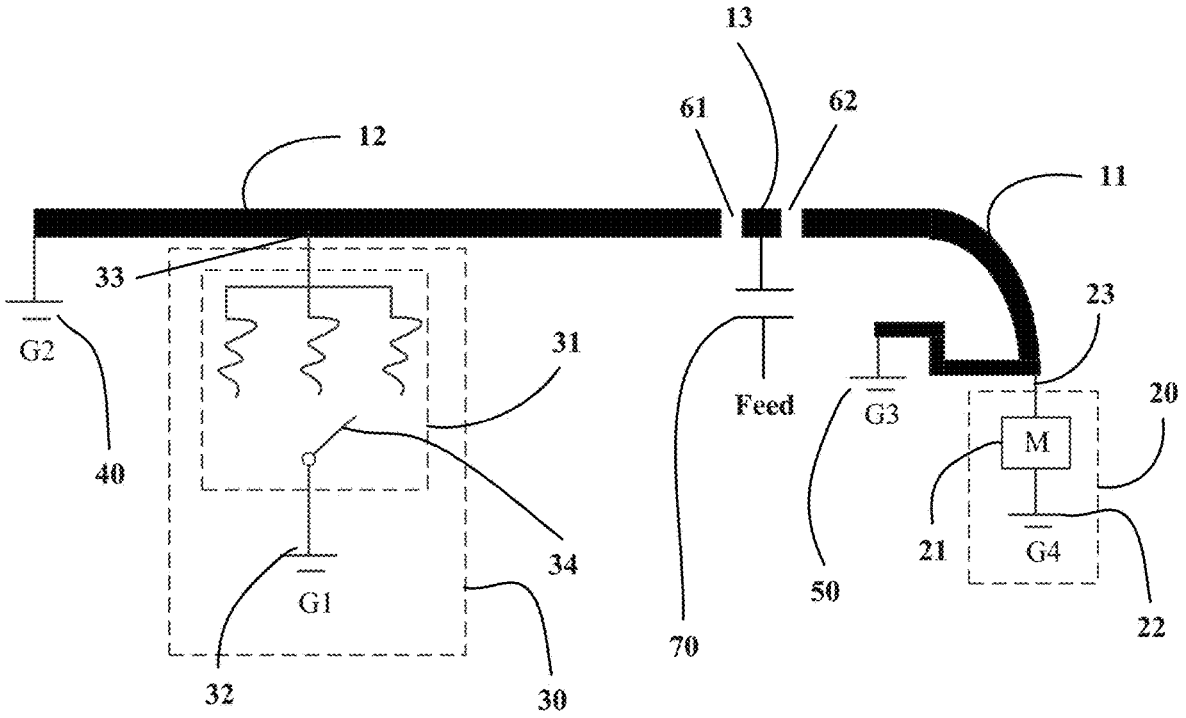
FIG. 8 is a schematic diagram of an antenna apparatus according to another embodiment of this application.

Referring to FIG. 8, G in FIG. 8 represents a ground point. FIG. 8 shows an antenna apparatus according to another embodiment of this application. Different from the antenna apparatus shown in FIG. 2, the antenna apparatus shown in FIG. 8 further includes a capacitor 70 connected in series between the feed point 13 and a power supply side. A capacitance value of the capacitor 70 is within a preset range, and can simultaneously cover three low frequency bands, for example, the LTE B5, the LTE B8, and the LTE B28.

Same as the antenna apparatus shown in FIG. 2, the antenna apparatus shown in FIG. 8 may simultaneously cover two low frequency bands. Specifically, when the matching circuit 31 connected in series between the third ground end 32 (G1) and the first connection end 33 is in a closed-circuit state, the radiator between the first gap 61 and the first connection end 33 radiates the first low frequency band signal. Specifically, when the matching circuit 31 connected in series between the third ground end 32 (G1) and the first connection end 33 is in the closed-circuit state, the radiator between the second gap 62 and the second ground end 50 (G3) radiates the second low frequency band signal.

In addition, when the matching circuit 31 connected in series between the third ground end 32 (G1) and the first connection end 33 is in the closed-circuit state, a radiator between the first connection end 33 and the second ground end 50 (G3) may radiate the third low frequency band signal, for example, a LTE B28 signal.

Figure 9:
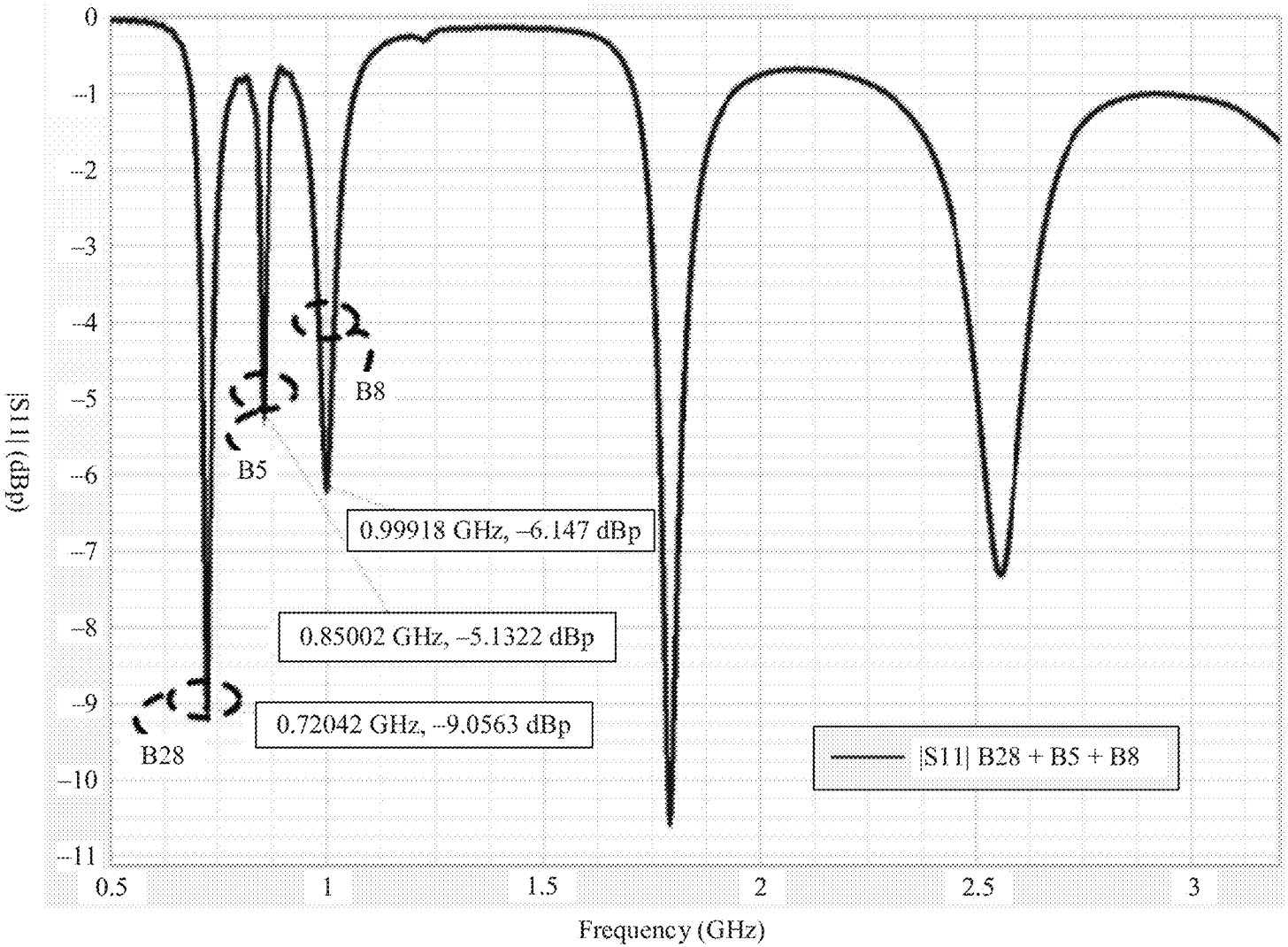
FIG. 9 is a schematic simulation diagram of three low frequency bands simultaneously covered by the antenna apparatus shown in FIG. 8.

In other words, when the matching circuit 31 is in the closed-circuit state, the antenna apparatus may simultaneously radiate signals of two low frequency bands, so that low-frequency 3 carrier aggregation (3 carrier aggregation, 3CA) can be supported. FIG. 9 shows simulation of signals of three low frequency bands (the LTE B5, the LTE B8, and the LTE B28) simultaneously radiated by the antenna apparatus.

Figure 10:
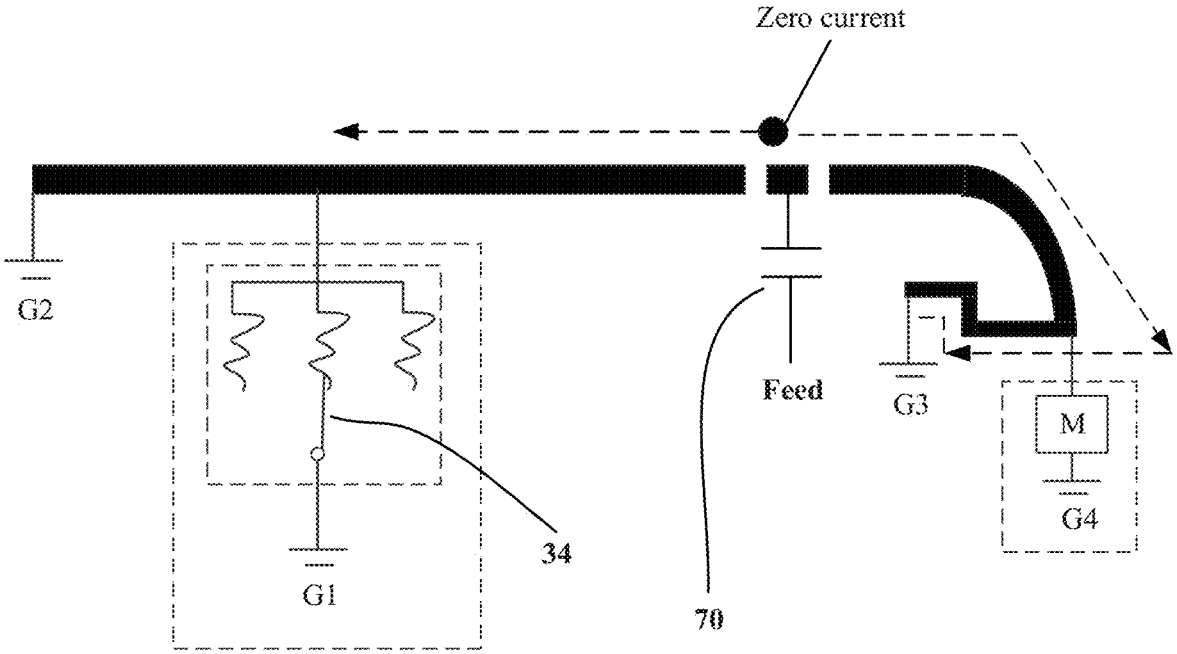
FIG. 10 is a schematic diagram of current distribution of a third low frequency band signal generated by the antenna apparatus shown in FIG. 8.

FIG. 10 shows current distribution of the third low frequency band signal radiated by the antenna apparatus shown in FIG. 8. As shown in FIG. 10, the third low frequency band signal (for example, the LTE B28) is radiated by the radiator between the first connection end 33 and the second ground end 50 (G3). The current zero occurs on the radiator between the first connection end 33 and the second ground end 50 (G3), and radiation of a third low frequency band signal (for example, the LTE B28) is in a half wavelength mode of the radiator between the first connection end 33 and the second ground end 50 (G3).

Figure 11:
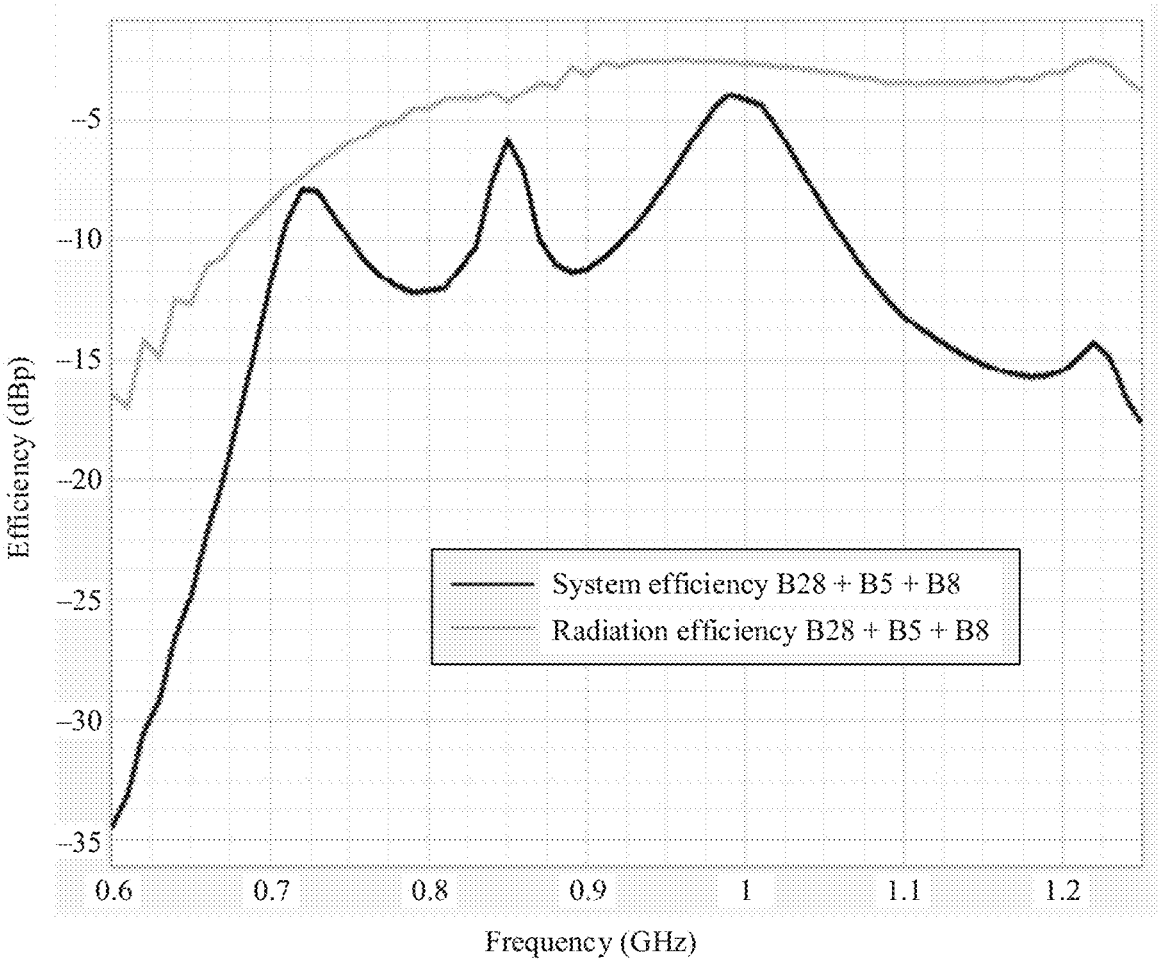
FIG. 11 is a simulation diagram of efficiency of the antenna apparatus shown in FIG. 8 radiating LTE B5, LTE B8, and LTE B28 signals.

In addition, FIG. 11 shows simulation of efficiency of the antenna apparatus shown in FIG. 8 simultaneously radiating the signals of the three low frequency bands (the LTE B5, the LTE B8, and the LTE B28). It can be learned that efficiency of the antenna apparatus shown in FIG. 8 simultaneously radiating the signals of the three low frequency bands is relatively high, without an obvious efficiency dent.

Figure 12:
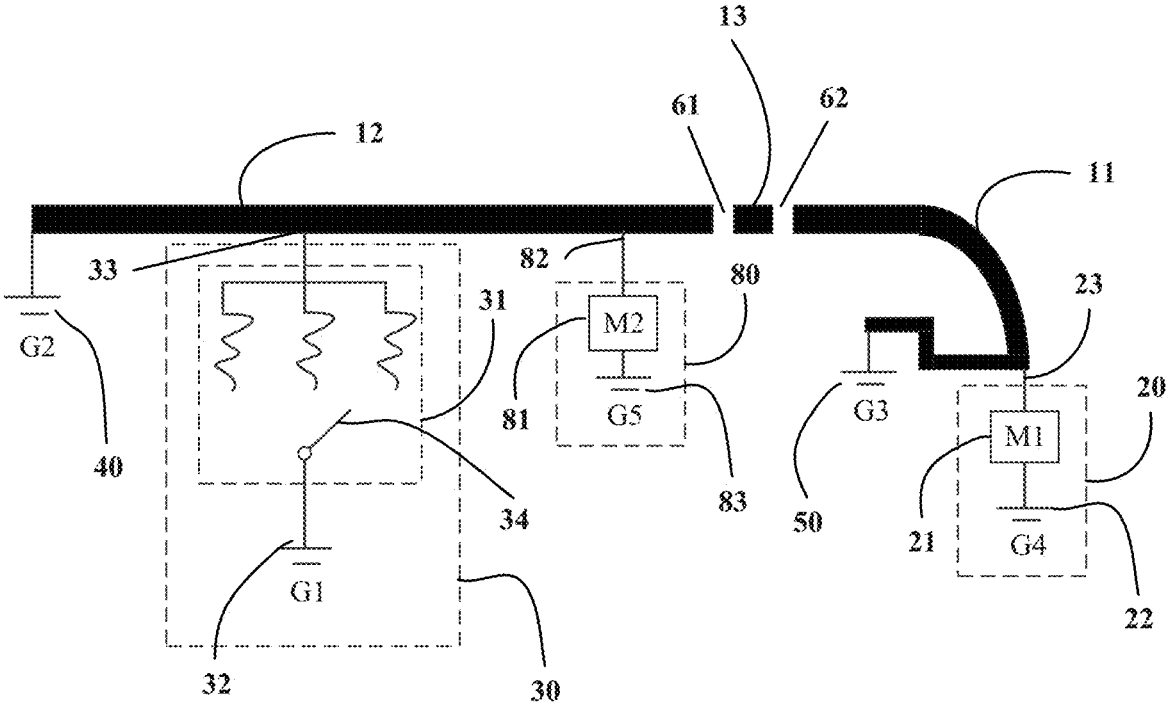
FIG. 12 is a schematic diagram of an antenna apparatus according to still another embodiment of this application.

Referring to FIG. 12, in FIG. 12, G represents a ground point, and M represents a filter. FIG. 12 shows an antenna apparatus according to still another embodiment of this application. Different from the antenna apparatus shown in FIG. 2, the antenna apparatus shown in FIG. 12 may further include a third grounding branch 80. The third grounding branch 80 may include a fifth ground end 83 (G5) and a third connection end 82. The third connection end 82 is located at an intersection position between the third grounding branch 80 and the first radiation section 12, and a second high-frequency filter 81 (M2) is connected in series between the third connection end 82 and the fifth ground end 83. The ground point G5 is added to the first radiation section 12, and M1 and M2 are band-pass filters of different high frequency bands. In this way, another CRLH mode may be generated at a high frequency.

Same as the antenna apparatus shown in FIG. 2, the antenna apparatus shown in FIG. 12 may simultaneously cover two low frequency bands. Specifically, when the matching circuit 31 connected in series between the third ground end 32 (G1) and the first connection end 33 is in a closed-circuit state, the radiator between the first gap 61 and the first connection end 33 radiates the first low frequency band signal. Specifically, when the matching circuit 31 connected in series between the third ground end 32 (G1) and the first connection end 33 is in the closed-circuit state, the radiator between the second gap 62 and the second ground end 50 (G3) radiates the second low frequency band signal.

In addition, the antenna apparatus shown in FIG. 12 may further simultaneously cover two high frequency bands. Details are as follows.

Specifically, the radiator between the second gap 62 and the second connection end 23 may radiate the first high frequency band signal. The first high frequency band herein is a frequency band that is allowed to pass through the first high frequency filter 21 (M1). In an optional implementation, the first high-frequency filter 21 (M1) may be a band-pass filter of the LTE B3, and is configured for the radiation section between the second gap 62 and the second connection end 23, to radiate the high-frequency signal of the LTE B3. The first high frequency band may be, but is not limited to, the LTE B3.

Specifically, the radiator between the first gap 61 and the first connection end 33 may radiate the second high frequency band signal. The second high frequency band herein is a frequency band that is allowed to pass through the second high frequency filter 81 (M2). In an optional implementation, the second high-frequency filter 81 (M2) may be a band-pass filter of the LTE B4, and is configured for the radiation section between the first gap 61 and the first connection end 33, to radiate a high-frequency signal of the LTE B4. The second high frequency band may be, but is not limited to, the LTE B4.

The antenna apparatus shown in FIG. 12 has two radiation sections on two sides of the feed point. The two radiation sections are not directly connected to the feed point, but are coupled to the feed point through the gaps. M1 and M2 are band-pass filters of different high frequency bands. G1, G2, G3, and G4 are four ground points of the antenna. A switch is added to G1 to switch the low frequency band. It can be learned that the antenna apparatus shown in FIG. 12 may simultaneously cover two low frequency bands and two high frequency bands, and specifically, the antenna apparatus may simultaneously cover the LTE B5, the LTE B8, and a full high frequency band.

Figure 13A:
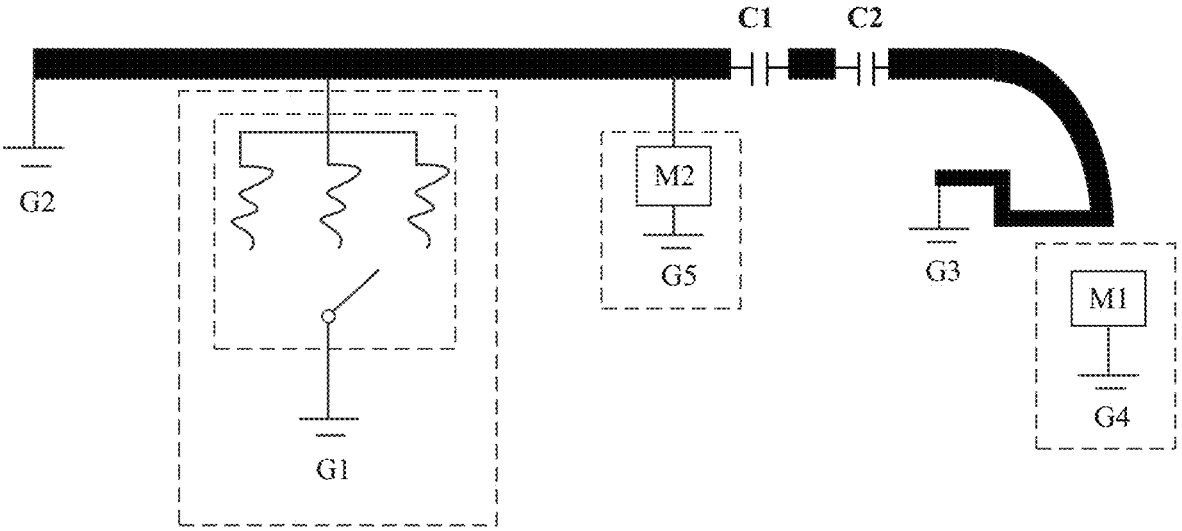
FIG. 13A to FIG. 13C are schematic diagrams of several alternative manners of gaps on two sides of a feed point in an antenna apparatus according to this application.

In some optional implementations, as shown in FIG. 13A, in the first gap 61, a lumped capacitor C1 may be connected in series between the feed point 13 and the first radiation section 12; and in the second gap 62, a lumped capacitor C2 may be connected in series between the feed point 13 and the second radiation section 11. In other words, the gap between the feed point 13 and the first radiation section 12 and the gap between the feed point 13 and the second radiation section 11 may be replaced with the lumped capacitor.

Figure 13B:
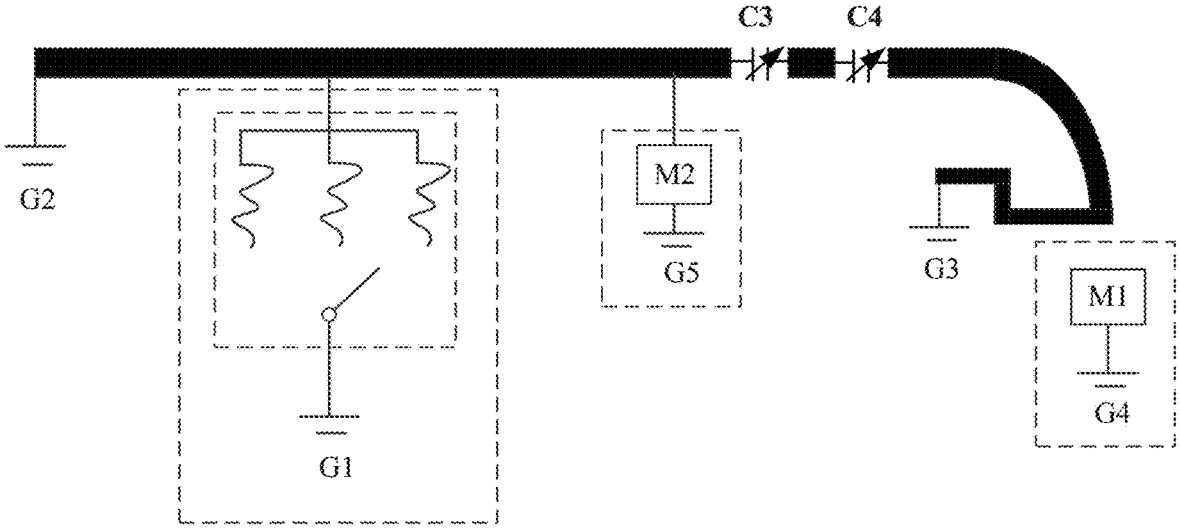

In some optional implementations, as shown in FIG. 13B, in the first gap 61, a variable capacitor C3 may be connected in series between the feed point 13 and the first radiation section 12; and in the second gap 62, a variable capacitor C4 may be connected in series between the feed point 13 and the second radiation section 11. In other words, the gap between the feed point 13 and the first radiation section 12 and the gap between the feed point 13 and the second radiation section 11 may be replaced with the variable capacitor.

Figure 13C:
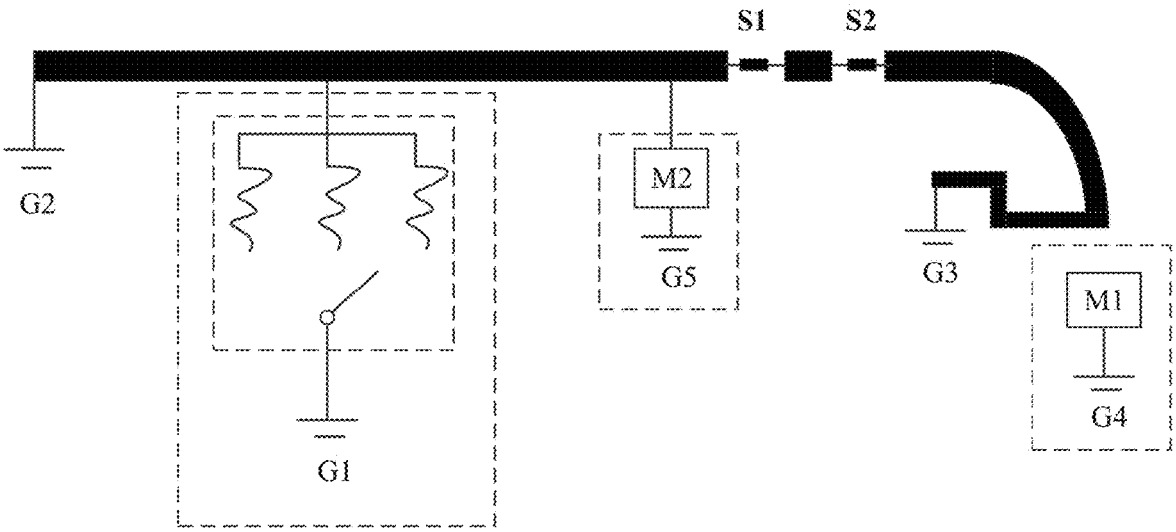

In some optional implementations, as shown in FIG. 13C, in the first gap 61, a tuning switch S1 may be connected in series between the feed point 13 and the first radiation section 12; and in the second gap 62, a tuning switch S2 may be connected in series between the feed point 13 and the second radiation section 11. In other words, the gap between the feed point 13 and the first radiation section 12 and the gap between the feed point 13 and the second radiation section 11 may be replaced with the tuning switch.

This is not limited to that shown in FIG. 13A to FIG. 13C. The gap between the feed point 13 and the first radiation section 12 and the gap between the feed point 13 and the second radiation section 11 may alternatively be replaced by a device in another form. This is not limited in this application.

The antenna apparatus shown in FIG. 2 or FIG. 8 is not limited to the antenna apparatus shown in FIG. 12, and the gaps in the antenna apparatus shown in FIG. 2 or FIG. 8 may also be replaced with the lumped capacitor, the variable capacitor, or the tuning switch.

Figure 14:
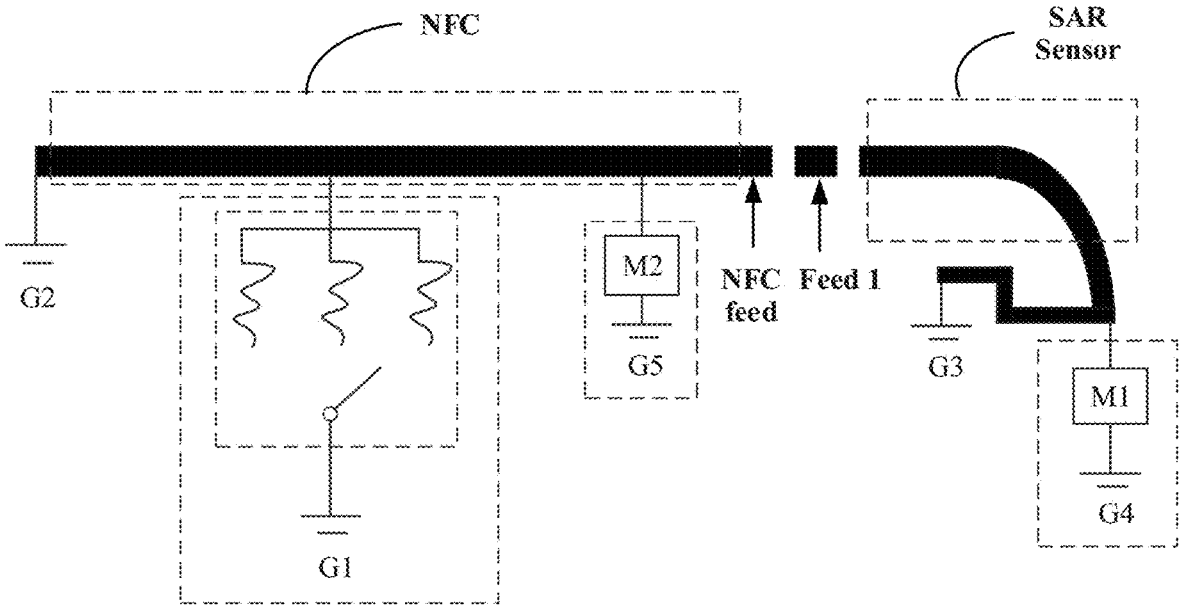
FIG. 14 is a schematic diagram of an antenna apparatus according to still another embodiment of this application.

Referring to FIG. 14, in FIG. 14, G represents a ground point, and M represents a filter. FIG. 14 shows an antenna apparatus according to still another embodiment of this application.

Different from the antenna apparatus shown in FIG. 2, the antenna apparatus shown in FIG. 14 may further include a third grounding branch 80. The third grounding branch 80 may include a fifth ground end 83 (G5) and a third connection end 82. The third connection end 82 is located at an intersection position between the third grounding branch 80 and the first radiation section 12, and a second high-frequency filter 81 (M2) is connected in series between the third connection end 82 and the fifth ground end 83. In addition, a second feed point is disposed at one end that is of the first radiation section 12 and that is close to the first gap 61, and the first radiation section 12 may radiate a first frequency band signal. The second radiation section 11 herein may be configured to detect a specific absorption ratio SAR of a second frequency band signal. The second frequency band is far higher than the first frequency band, and a difference between the second frequency band and the first frequency band is greater than a first preset threshold. A value of the first preset threshold is not particularly limited in this application.

Herein, there is no inclusion relationship between the first frequency band and the first low frequency band, and the first frequency band is a concept independent of the first low frequency band. Likewise, the second frequency band is a concept independent of the second low frequency band.

In an optional implementation, as shown in FIG. 14, the second feed point may be a near field communication NFC feed point, and the first frequency band signal is an NFC signal. A frequency of the NFC signal is approximately 13.56 MHz, which is far lower than a high frequency band of mobile communications such as the LTE B3 and the LTE B4.

It can be learned that in the antenna apparatus shown in FIG. 14, the first radiation section 12 may be used as a radiator that is a part of the NFC antenna, and the second radiation section 11 may be used as a radiator that is a part of an SAR sensor. The SAR sensor may be configured to detect an SAR of a high-frequency signal. In this way, a compatible design of the NFC antenna and the SAR sensor can be implemented.

This is not limited to the compatibility design of the NFC antenna and the SAR sensor, and the second feed point may be a feed point of another low-frequency signal. The antenna apparatus shown in FIG. 14 may also be implemented as a compatibility design of two antennas whose operating frequency bands differ greatly.

In addition, the antenna apparatus provided in this application is applied to the mobile terminal. The mobile terminal may be a smartphone, and the mobile terminal may include a metal housing. The radiator of the antenna apparatus provided in this application may be a portion of the metal housing. How to use the metal housing to constitute the radiator of the antenna apparatus provided in this application is not limited herein. Optionally, the radiator of the antenna apparatus provided in this application may be disposed inside the metal housing. How to arrange the radiator of the antenna apparatus provided in this application inside the metal housing is not limited herein.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An antenna apparatus comprising:

a first radiator comprising:

a feed point comprising:

a first side; and a second side;

a first radiation section disposed on the first side and comprising a first end;

a second radiation section disposed on the second side and comprising a second end;

a first gap disposed between the first radiation section and the feed point, wherein the first end is located away from the first gap;

a second gap disposed between the second radiation section and the feed point, wherein the second end is located away from the second gap;

a first ground end disposed at the first end; and a second ground end disposed at the second end;

a first grounding branch coupled to the first radiator and comprising:

a third ground end;

a first connection end located at a first intersection position between the first grounding branch and the first radiation section; and a matching circuit coupled in series between the first connection end and the third ground end; and a second grounding branch coupled to the first radiator and comprising:

a fourth ground end;

a second connection end located at a second intersection position between the second grounding branch and the second radiation section; and a first high-frequency filter coupled in series between the second connection end and the fourth ground end.

2. The antenna apparatus of claim 1, wherein when the matching circuit is in a closed-circuit state:

a second radiator between the first gap and the first connection end is configured to radiate a first low frequency band signal;

the matching circuit is configured to perform a frequency modulation on the first low frequency band signal; and a third radiator between the second gap and the second ground end is configured to radiate a second low frequency band signal, and wherein a fourth radiator between the first gap and the first ground end is configured to radiate a third low frequency band signal when the matching circuit is in an open-circuit state.

3. The antenna apparatus of claim 1, wherein a fifth radiator is disposed between the second gap and the second connection end of the first radiator and is configured to radiate a first high frequency band signal, and wherein the first high-frequency filter is configured to allow the first high frequency band signal to pass through.

4. The antenna apparatus of claim 1, wherein the first radiation section is configured to radiate a second high frequency band signal in a state when a current zero occurs on the first radiation section.

5. The antenna apparatus of claim 1, further comprising a capacitor coupled in series between the feed point and a power supply side, wherein a capacitance value of the capacitor is within a preset range, and wherein a sixth radiator is disposed between the first connection end and the second ground end of the first radiator and is configured to radiate a third low frequency band signal when the matching circuit is in a closed-circuit state.

6. The antenna apparatus of claim 1, further comprising a third grounding branch, wherein the third grounding branch comprises:

a fifth ground end;

a third connection end located at a third intersection position between the third grounding branch and the first radiation section; and a second high-frequency filter coupled in series between the third connection end and the fifth ground end.

7. The antenna apparatus of claim 1, further comprising:

a first lumped capacitor coupled in series between the feed point and the first radiation section in the first gap; and a second lumped capacitor coupled in series between the feed point and the second radiation section in the second gap.

8. The antenna apparatus of claim 1, further comprising:

a first variable capacitor coupled in series between the feed point and the first radiation section in the first gap; and a second variable capacitor coupled in series between the feed point and the second radiation section in the second gap.

9. The antenna apparatus of claim 1, further comprising:

a first antenna tuning switch coupled in series between the feed point and the first radiation section in the first gap; and a second antenna tuning switch coupled in series between the feed point and the second radiation section in the second gap.

10. The antenna apparatus of claim 1, further comprising:

a third grounding branch comprising:

a fifth ground end;

a third connection end located at a third intersection position between the third grounding branch and the first radiation section; and a second high-frequency filter coupled in series between the third connection end and the fifth ground end; and a second feed point disposed at a third end of the first radiation section proximate to the first gap, wherein the first radiation section is configured to radiate a first frequency band signal, wherein the second radiation section is configured to detect a specific absorption ratio (SAR) of a second frequency band signal, wherein a second frequency band is higher than a first frequency band, and wherein a difference between the second frequency band and the first frequency band is greater than a first preset threshold.

11. The antenna apparatus of claim 10, wherein the second feed point comprises a Near-Field-Communication (NFC) feed point, and wherein the first frequency band signal comprises an NFC signal.

12. A mobile terminal comprising:

an antenna apparatus comprising:

a first radiator comprising:

a feed point comprising:

a first side; and a second side;

a first radiation section disposed on the first side and comprising a first end;

a second radiation section disposed on the second side and comprising a second end;

a first gap disposed between the first radiation section and the feed point, wherein the first end is located away from the first gap;

a second gap disposed between the second radiation section and the feed point, wherein the second end is located away from the second gap;

a first ground end disposed at the first end; and a second ground end disposed at the second end;

a first grounding branch coupled to the first radiator and comprising:

a third ground end;

a first connection end located at a first intersection position between the first grounding branch and the first radiation section; and a matching circuit coupled in series between the first connection end and the third ground end; and a second grounding branch coupled to the first radiator and comprising:

a fourth ground end;

a second connection end located at a second intersection position between the second grounding branch and the second radiation section; and a first high-frequency filter coupled in series between the second connection end and the fourth ground end; and a metal housing, wherein the first radiator is a portion of the metal housing or the first radiator is disposed inside the metal housing.

13. The mobile terminal of claim 12, wherein when the matching circuit is in a closed-circuit state:

a second radiator between the first gap and the first connection end is configured to radiate a first low frequency band signal;

the matching circuit is configured to perform a frequency modulation on the first low frequency band signal; and a third radiator between the second gap and the second ground end is configured to radiate a second low frequency band signal, and wherein a fourth radiator between the first gap and the first ground end is configured to radiate a third low frequency band signal when the matching circuit is in an open-circuit state.

14. The mobile terminal of claim 12, wherein a fifth radiator is disposed between the second gap and the second connection end of the first radiator and is configured to radiate a first high frequency band signal, and wherein the first-high frequency filter is configured to allow the first high frequency band signal to pass through.

15. The mobile terminal of claim 12, wherein the first radiation section is configured to radiate a second high frequency band signal in a state when a current zero occurs on the first radiation section.

16. The mobile terminal of claim 12, wherein the antenna apparatus further comprises a capacitor coupled in series between the feed point and a power supply side, wherein a capacitance value of the capacitor is within a preset range, and wherein a sixth radiator is disposed between the first connection end and the second ground end of the first radiator and is configured to radiate a third low frequency band signal when the matching circuit is in a closed-circuit state.

17. The mobile terminal of claim 12, wherein the antenna apparatus further comprises a third grounding branch comprising:

a fifth ground end;

a third connection end located at a third intersection position between the third grounding branch and the first radiation section; and a second high-frequency filter coupled in series between the third connection end and the fifth ground end.

18. The mobile terminal of claim 12, wherein the antenna apparatus further comprises:

a first lumped capacitor coupled in series between the feed point and the first radiation section in the first gap; and a second lumped capacitor coupled in series between the feed point and the second radiation section in the second gap.

19. The mobile terminal of claim 12, wherein the antenna apparatus further comprises:

a third grounding branch comprising:

a fifth ground end;

a third connection end located at a third intersection position between the third grounding branch and the first radiation section; and a second high-frequency filter coupled in series between the third connection end and the fifth ground end; and a second feed point disposed at a third end of the first radiation section proximate to the first gap, wherein the first radiation section is configured to radiate a first frequency band signal, wherein the second radiation section is configured to detect a specific absorption ratio (SAR) of a second frequency band signal, wherein a second frequency band is higher than a first frequency band, and wherein a difference between the second frequency band and the first frequency band is greater than a first preset threshold.

20. The mobile terminal of claim 19, wherein the second feed point comprises a Near-Field-Communication (NFC) feed point, and wherein the first frequency band signal comprises an NFC signal.

* * * * *